US007322805B2

(12) United States Patent
Biver et al.

(10) Patent No.: US 7,322,805 B2
(45) Date of Patent: Jan. 29, 2008

(54) IMPELLER ADJUSTMENT DEVICE AND METHOD FOR DOING THE SAME FOR CLOSE COUPLED PUMPS

(75) Inventors: Paul J. Biver, Skaneateles, NY (US); Mark A. Playford, Seneca Falls, NY (US); Jeremiah D. Quill, Auburn, NY (US); Gregory L. Peck, North Rose, NY (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 689 days.

(21) Appl. No.: 10/769,457

(22) Filed: Jan. 30, 2004

(65) Prior Publication Data

US 2005/0169783 A1 Aug. 4, 2005

(51) Int. Cl.

| | |
|---|---|
| ***F04B 17/00*** | (2006.01) |
| *F04B 35/00* | (2006.01) |
| *B23P 6/00* | (2006.01) |
| *B23P 15/00* | (2006.01) |

(52) U.S. Cl. ..... 417/423.1; 417/359; 417/360; 417/361; 29/888; 29/888.02; 29/888.021; 415/126; 415/131

(58) Field of Classification Search ..... 417/423.1, 417/359, 360, 361; 415/126, 131; 29/888, 29/888.02, 888.021, 888.022, 888.023
See application file for complete search history.

(56) References Cited

U.S. PATENT DOCUMENTS

| | | | | |
|---|---|---|---|---|
| 1,891,267 | A | 12/1932 | Milkowski | |
| 2,862,453 | A | 12/1958 | Nagle | |
| 3,188,966 | A | 6/1965 | Tetlow | |
| 3,411,450 | A | 11/1968 | Clifton | |
| 3,771,927 | A | 11/1973 | Schiller | |
| 4,439,096 | A | 3/1984 | Rockwood et al. | |
| 4,509,773 | A | 4/1985 | Wentworth | |
| 4,521,151 | A | 6/1985 | Frater et al. | |
| 4,702,672 | A | 10/1987 | Leicht et al. | |
| 5,030,018 | A * | 7/1991 | Korenblit | 384/519 |
| 5,344,291 | A | 9/1994 | Antkowiak | |
| 5,951,244 | A * | 9/1999 | Knight, Sr. | 415/132 |
| 6,375,414 | B1 | 4/2002 | Delaney | |
| 6,893,213 | B1 * | 5/2005 | Quill et al. | 415/131 |

* cited by examiner

*Primary Examiner*—Anthony D. Stashick
*Assistant Examiner*—Patrick Hamo

(57) ABSTRACT

A method and apparatus are provided for adjusting an impeller in a motor and impeller assembly of a pumping device. The method features steps of: tightening mounting bolts so as to move the motor and impeller assembly of the pumping device forward until the impeller touches a casing; inserting a feeler gauge in radial slots in a frame adapter and measuring a gap between a housing of the motor and the frame adapter; determining a desired impeller adjustment distance based on the gap and the desired impeller running clearance; selecting at least one shim having a thickness that corresponds to the desired impeller adjustment distance; loosening the mounting bolts and threading jacking bolts arranged in the rear of the pump frame adapter so that the jacking bolts push against the housing of the motor, and the shims can then be inserted into the radial slots; inserting the shims into the radial slots; backing out the jacking bolts; and securing the mounting bolts locking the motor and impeller assembly in position so that the impeller is at the desired impeller adjustment distance in relation to the casing. The frame adapter assembly features a frame adapter having four radial slots to enable access to the gap for measurement with a feeler gauge and for insertion of the shim to accurately set the impeller clearance.

5 Claims, 4 Drawing Sheets

IMPELLER ADJUSTMENT DEVICE AND METHOD FOR DOING THE SAME FOR CLOSE COUPLED PUMPS

BACKGROUND OF THE INVENTION

1. Field of Invention

The present invention relates to a method and apparatus for adjusting an impeller coupled to a motor in relation to an impeller assembly; and more particularly relates to a method and apparatus for adjusting such an impeller in a close coupled centrifugal pump.

2. Description of Related Art

Internal bushings or shims to set impeller clearance for optimum pump performance are known. However, current devices are difficult to set accurately and reside in the process fluids where they are susceptible to corrosion/erosion. Current methods and apparatus require the user to completely assemble the pump, then insert a feeler gauge into the suction (which is often only 1" diameter) to set the impeller-to-casing clearance. Then the unit must be disassembled and the appropriate bushing or shims added to the shaft behind the impeller hub. The units are then reassembled and the clearances re-checked. Since gasket and/or o-ring compression can be different at each assembly, this can lead to this process being repeated a multitude of times before it is correct. Due to this complicated process, many times impeller clearances are simply set "close" and hereby cause the pumps to operate under conditions which produce less flow and head as well as consume more energy. Since these bushings/shims are in the process flow, the metallurgy must be selected to be compatible with the pump fluid to avoid corrosion attack, which in many cases is very costly.

SUMMARY OF INVENTION

The present invention provides a new and unique a method and apparatus for adjusting an impeller in a close coupled pumping device. The method features the steps of: tightening mounting bolts so as to move the motor and impeller assembly of the pumping device forward until the impeller touches a casing; inserting a feeler gauge in radial slots in a frame adapter and measuring a gap between a housing of the motor and the frame adapter; determining a required impeller adjustment distance by adding the desired impeller running clearance to the feeler gage thickness determined by measuring the gap at the radial slots; selecting at least one shim having a thickness that corresponds to the desired impeller adjustment distance; loosening the mounting bolts and threading jacking bolts arranged in the rear of the pump frame adapter so that the jacking bolts push against the housing of the motor and the shims can be inserted into the radial slots; inserting the shims into the radial slots; backing out the jacking bolts; and securing the mounting bolts locking the motor and impeller assembly in position so that the impeller is at the desired impeller adjustment distance in relation to the casing.

In accordance with the present invention, the frame adapter assembly features a frame adapter having four radial slots to enable access to the gap for measurement with a feeler gauge and for insertion of the shim to accurately set the impeller clearance. The invention is not limited to using separate mounting bolts and/or jacking bolts but includes any type of jacking/locking bolt assembly (single or multiple).

One advantage of the invention is that it allows impeller adjustment externally while the unit is fully assembled.

Tolerance can be renewed at any time to maintain optimum unit performance without disassembly, thereby extending the unit life and lowering operating costs. The invention also does not require any internal bushings or shims that can corrode in the process fluid.

BRIEF DESCRIPTION OF THE DRAWING

The drawing, not drawn to scale, includes the following Figures.

DETAILED DESCRIPTION OF INVENTION

Figure 1:
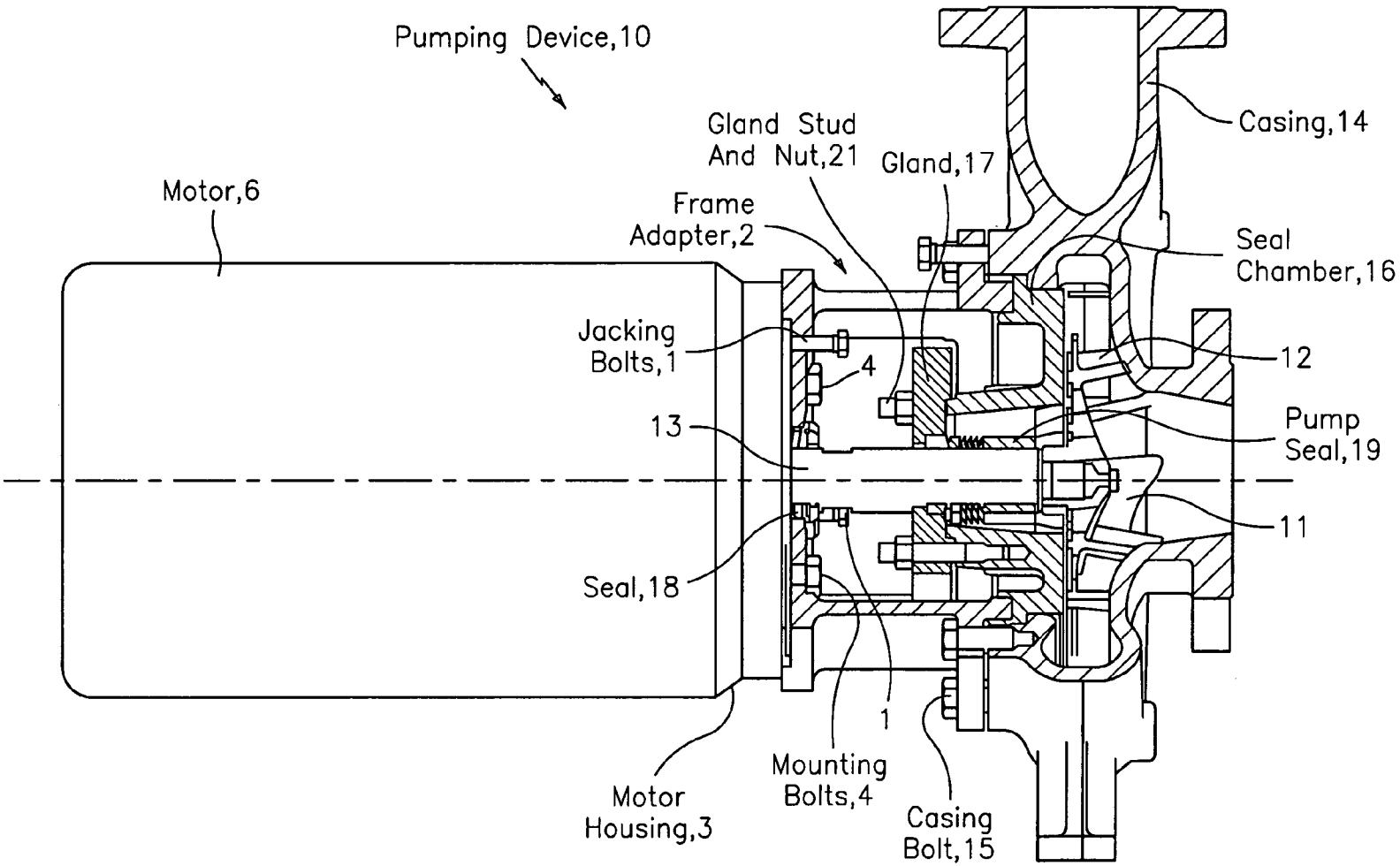
FIG. 1 is a side cross-sectional view of a pumping device that is the subject matter of the present invention.

FIGS. 1-4 show a pumping device 10 having a pump frame adapter 2 for coupling a motor 6 to an impeller assembly 12 having an impeller 11 arranged on an impeller shaft 13. In accordance with the present invention, the impeller 11 is adjusted in the impeller assembly 12, as follows:

The pumping device 10 has jacking bolts 1 in the rear of the pump frame adapter 2 that push against a motor housing 3 of the motor 6.

During assembly, the pump frame adapter 2 is mounted to the motor 6 and secured with mounting bolts 4. The mounting bolts 4 should all be tightened until the pump frame adapter 2 is tight against the motor housing 3. A seal 18 is pushed on to the impeller shaft 13 and seated into the pump frame adapter 2. The pump seal assembly consisting of a gland 17 and a pump seal 19 are positioned on the impeller shaft 13. A seal chamber 16 is mounted on the pump frame adapter 2 and secured with screws (not shown). The gland 17 is then secured to the seal chamber 16 with a gland stud and nut 21. The impeller 11 is attached to the impeller shaft 13. The mounting bolts 4 are loosened 2 to 3 turns and the jacking bolts or screws 1 are threaded further into the frame adapter 2 until the impeller 11 contacts the seal chamber 16. A casing 14 is mounted on the seal chamber 16 and casing bolts 15 are inserted through the holes in the pump frame adapter 2 and threaded into the casing 14. The casing bolts 15 are tightened.

Once the unit is assembled, the jacking bolts 1 are then backed out.

Then the mounting bolts 4 are tightened moving the motor 6 and the impeller assembly 12 forward until it touches the casing (turning the impeller shaft 13 to make sure contact is made). Next, a feeler gauge (not shown) is inserted at the radial slots 20 (See also FIGS. 2 and 3) in the pump frame adapter 2 and the gap G between the motor housing 3 and the pump frame adapter 2 is measured. The recommended running clearance is added to the measured gap G and a shim of this thickness is selected. The mounting bolts 4 are then loosened, and using the jacking bolts 1, the motor 6 is pushed away from the frame adapter 2 until the shims 5 can be inserted.

The mounting bolts 4 are then secured locking the impeller assembly 12 in position, as shown in FIG. 1.

Figure 2:
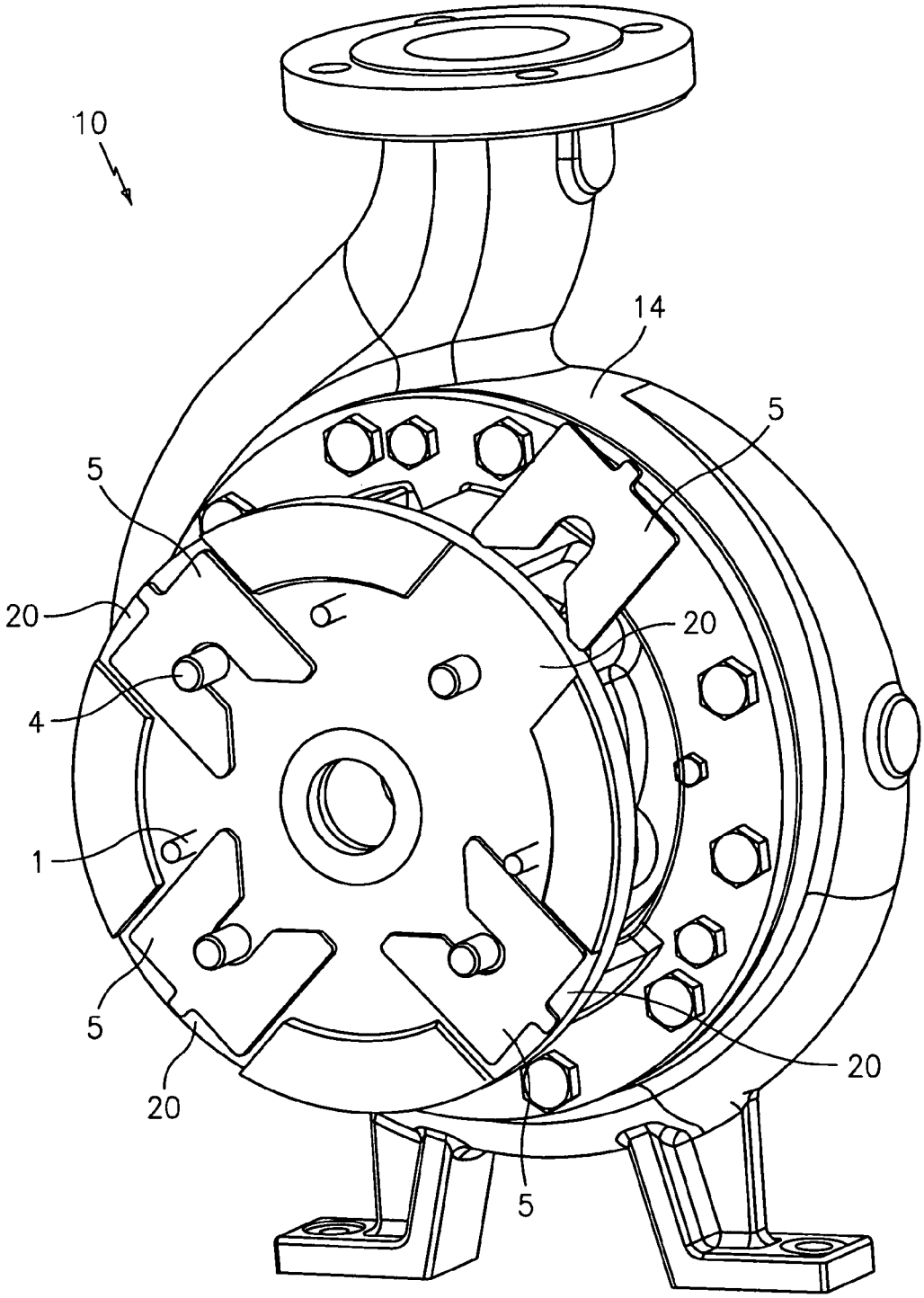
FIG. 2 is a view of an impeller assembly, which forms part of the pumping device shown in FIG. 1.
Figure 3:
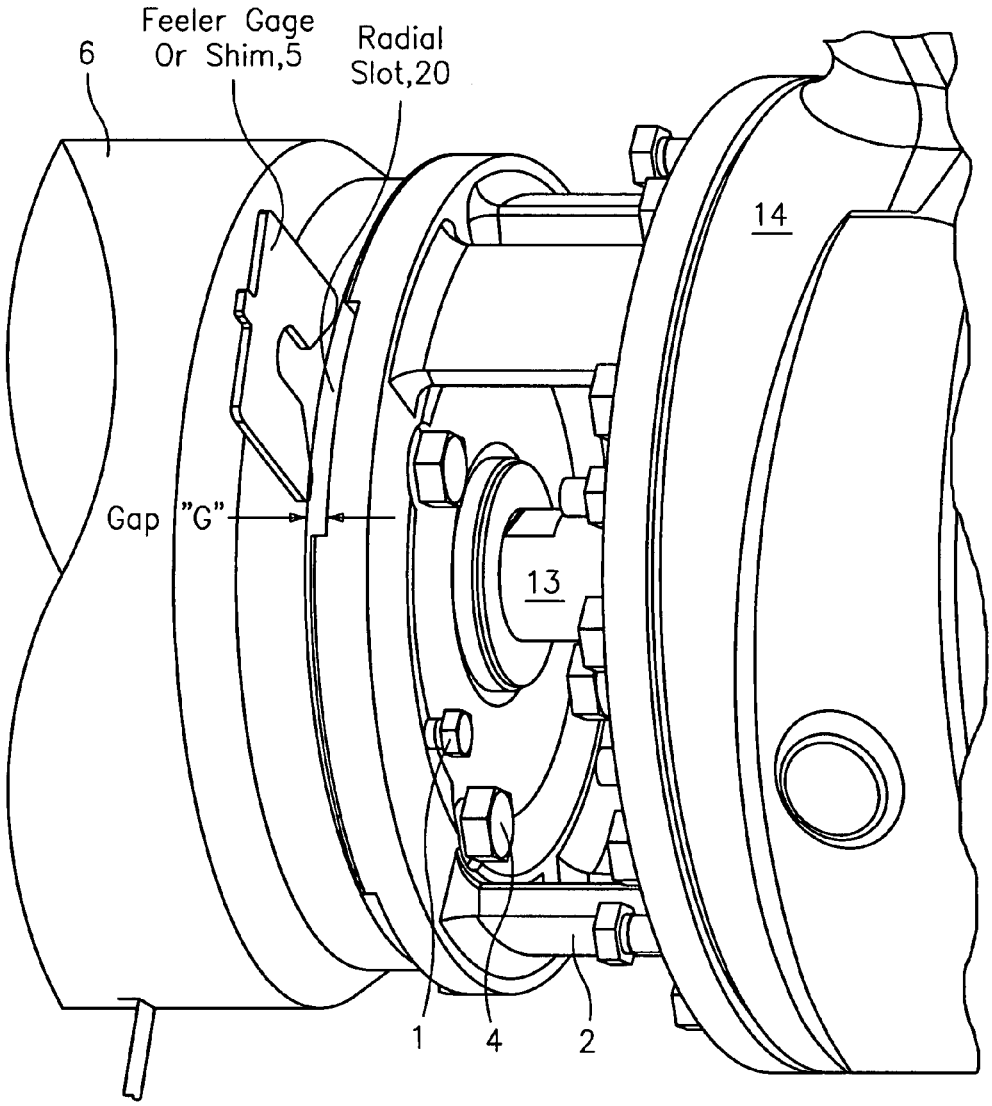
FIG. 3 is a partial enlarged perspective view of the impeller assembly shown in FIG. 1.
Figure 4:
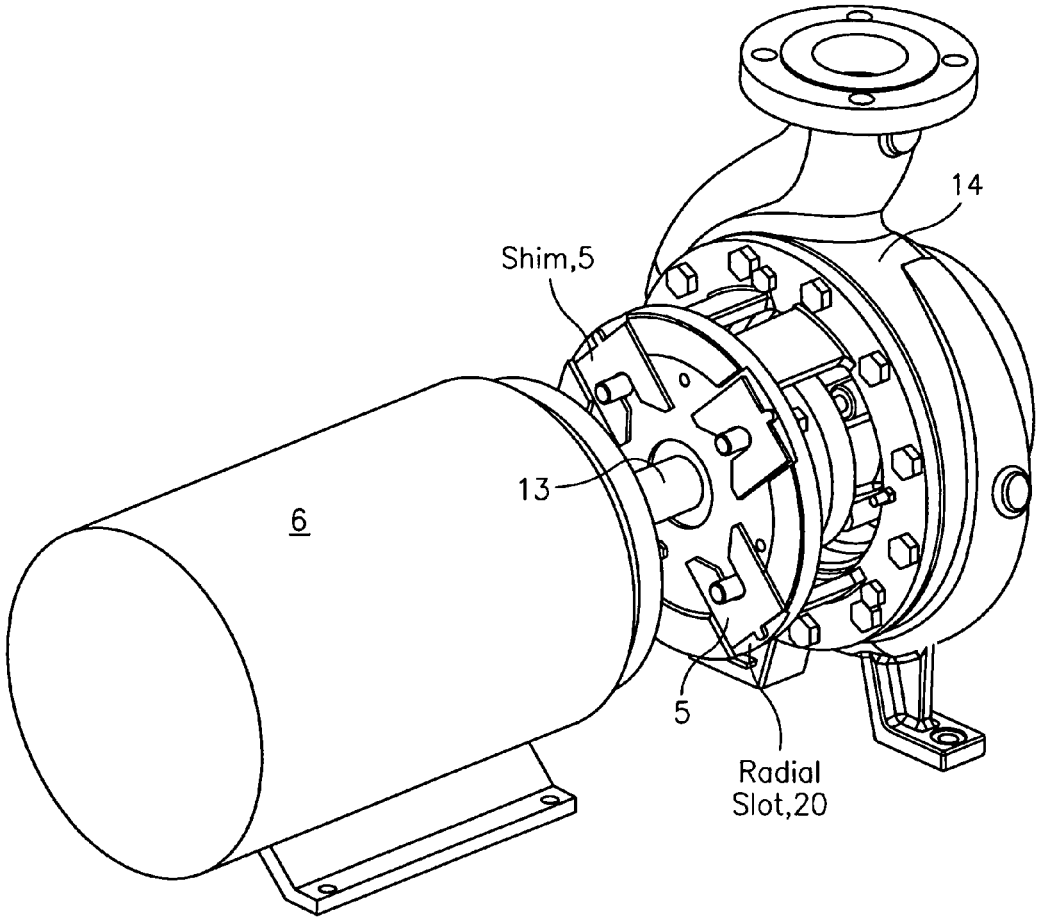
FIG. 4 is a partial exploded perspective view of the impeller assembly shown in FIG. 1.

The pump frame adapter 2 is unique in that it has the four radial slots 20 to enable access to the gap G for measurement with the feeler gauge (not shown) and for insertion of the shims 5 to accurately set the impeller clearance, as best shown in FIGS. 2 and 3. However, it is important to note that the present invention is not limited to using radial slots per se; embodiments are envisioned using other types of slot or a slotless configuration, such as dowel pins to maintain alignment of the motor to the adapter, rather than the rabbit lock between the motor and frame adapter that is currently shown in FIG. 1.

The invention is not limited to using separate mounting bolts 4 and/or jacking bolts 1 and may include any type of jacking/locking bolt assembly (single or multiple).

The scope of the invention is also intended to include using the present invention on close coupled motor/centrifugal pumps close coupled motor/positive displacement pumps or other electric motor driven products that require adjustment of internal components via an external device.

SCOPE OF THE INVENTION

Accordingly, the invention comprises the features of construction, combination of elements, and arrangement of parts which will be exemplified in the construction hereinafter set forth.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

We claim:

1. A method for adjusting an impeller in a motor and impeller assembly of a pumping device, including a close coupled pump, comprising the steps of:

tightening mounting bolts (4) so as to move the motor and impeller assembly of the pumping device forward until the impeller touches a casing;

inserting a feeler gauge in at least one radial slot in a frame adapter (2) and measuring a gap between a housing (3) of the motor and the frame adapter (2);

determining a required impeller adjustment distance by adding a desired impeller running clearance to a feeler gauge thickness determined by measuring the gap at the radial slots;

selecting at least one shim having a thickness that corresponds to the desired impeller adjustment distance;

loosening the mounting bolts (4) and threading jacking bolts (1) arranged in the rear of the pump frame adapter (2) so that the jacking bolts (1) push against the housing (3) of the motor and the shims (5) can be inserted into the at least one radial slot;

inserting the shims (5) into the at least one radial slots;

backing out the jacking bolts (1); and securing the mounting bolts (4) locking the motor and impeller assembly in position so that the impeller is at the desired impeller running clearance in relation to the casing.

2. A method according to claim 1, wherein the step of determining includes adding to the gap a recommended running clearance to get the desired impeller adjustment distance.

3. A method according to claim 1, wherein the method includes the step of:

turning an impeller shaft to make sure contact is made between the impeller and the casing.

4. A method according to claim 1, wherein the pumping device is a close coupled pump.

5. A method for adjusting an impeller in a pumping device, comprising the steps of:

threading jacking bolts (1) arranged in the rear of a pump frame adapter (2) until they push against a housing (3) of a motor;

assembling the remainder of the pumping device;

backing out the jacking bolts (1) once the remainder of the pumping device is assembled;

tightening the mounting bolts (4) so as to move the motor and impeller assembly forward until the impeller touches a casing;

inserting a feeler gauge in radial slots in the frame adapter (2) and measuring the gap between the motor housing (3) and the frame adapter (2);

adding to the gap a recommended running clearance to get a desired impeller adjustment distance;

selecting a shim having a thickness that corresponds to the desired impeller adjustment distance;

loosening the mounting bolts (4) and pushing the motor away from the frame adapter (2) using the jacking bolts (1) until the shims (5) can be inserted;

inserting the shims (5) into the radial slots; and securing the mounting bolts (4) locking the assembly in position.

* * * * *